US006038285A

United States Patent [19]

Zhong et al.

[11] Patent Number: 6,038,285

[45] Date of Patent: Mar. 14, 2000

[54] METHOD AND APPARATUS FOR PRODUCING MONOCHROMATIC RADIOGRAPHY WITH A BENT LAUE CRYSTAL

[76] Inventors: Zhong Zhong, Apt. I 1131 Chaping 700 E. Loop Rd., Stony Brook, N.Y. 11790; Leroy Dean Chapman, 4 Vermont Cir., Bolingbrook, Ill. 60440; William C. Thomlinson, 32 E. Masem, East Patchogue, N.Y. 11772

[21] Appl. No.: 09/016,891

[22] Filed: Feb. 2, 1998

[51] Int. Cl.[7] ..... G21K 1/06

[52] U.S. Cl. ..... 378/84; 378/85; 378/79

[58] Field of Search ..... 378/84, 85, 79

[56] References Cited

U.S. PATENT DOCUMENTS

| | | | |
|---|---|---|---|
| 2,543,630 | 2/1951 | Hansen . | |
| 2,853,617 | 9/1958 | Berreman . | |
| 3,032,656 | 5/1962 | Hosemann et al. . | |
| 3,439,163 | 4/1969 | De Jongh . | |
| 3,628,040 | 12/1971 | Schnopper et al. . | |
| 3,777,156 | 12/1973 | Hammond et al. . | |
| 3,885,153 | 5/1975 | Schoenborn et al. . | |
| 4,223,219 | 9/1980 | Born et al. . | |
| 4,351,063 | 9/1982 | Dineen et al. | 378/79 |
| 4,625,323 | 11/1986 | Okaya . | |
| 4,649,557 | 3/1987 | Hornstra et al. . | |
| 4,737,973 | 4/1988 | Ogawa et al. . | |
| 4,949,367 | 8/1990 | Huizing et al. . | |
| 5,123,036 | 6/1992 | Uno et al. . | |
| 5,127,028 | 6/1992 | Wittry . | |
| 5,164,975 | 11/1992 | Steinmeyer . | |
| 5,579,363 | 11/1996 | Ingal et al. . | |
| 5,923,720 | 7/1999 | Barton et al. | 378/84 |

OTHER PUBLICATIONS

Monochromatic energy–subtration radiography using a rotating anode source and a bent Laue monochromator, a paper pulbished in *Phys. Med. Biol.,* 42 (1997), pp. 1751–1762.

A bent Laue crystal monochromator for monochromatic radiography with an area beam, a paper published in *Nuclear Instruments and Methods in Physics Research, Section A,* 399 (1997), pp. 489–498.

*Primary Examiner*—David V. Bruce
*Assistant Examiner*—Michael J. Schwartz
*Attorney, Agent, or Firm*—Pauley Petersen Kinne & Fejer

[57] ABSTRACT

A method and apparatus for producing a monochromatic beam. A plurality of beams are generated from a polyenergetic source. The beams are then transmitted through a bent crystal, preferably a bent Laue crystal, having a non-cylindrical shape. A position of the bent crystal is rocked with respect to the polyenergetic source until a plurality of divergent monochromatic beams are emitted from the bent crystal.

16 Claims, 3 Drawing Sheets

METHOD AND APPARATUS FOR PRODUCING MONOCHROMATIC RADIOGRAPHY WITH A BENT LAUE CRYSTAL

This work was supported in part by U.S. Army Grant DAMD17-96-1-6143; U.S. Department of Energy Contract DE-AC02-76CH00016; and U.S. Department of Defense Advanced Research Projects Agency, ARPA Contract AOB227.

BACKGROUND OF THE INVENTION

1. Field of the Invention

This invention relates to a crystal monochromator, such as a bent Laue crystal monochromator, which diffracts a large area of divergent monochromatic beams or rays, such as X-rays.

2. Description of Prior Art

Conventional angiography systems use polychromatic X-rays and intra-arterial injection of contrast agents. Dual-energy subtraction imaging with intravenous injection of the contrast agent can produce usefuil images with much reduced risk. Early attempts at intravenous angiography with non-synchrotron X-rays included the use of filtered or kVp-modulated polychromatic X-rays and dual-energy subtraction methods. The broad spectra of the X-rays used by conventional methods requires three energies in order to minimize bone artefacts. Prior synchrotron-based patient studies using the dual-energy digital subtraction intravenous coronary angiography technique with monochromatic X-rays have obtained research quality images of the coronary artery anatomy. However, the cost of a synchrotron prevents its general use for clinical diagnostic imaging. Development of a compact source and a corresponding X-ray optics system is necessary for the technology to be widely utilized.

One of the recent developments of compact sources which would have sufficient intensity for digital subtraction coronary angiography is an X-ray generator with a rotating anode coated with barium and cerium. In addition to the desired characteristic X-rays, the bremsstrahlung radiation from the source is also present. This continuum in the emitted X-ray spectrum increases the dose to a patient, creates subtraction artifacts due to beam hardening effects, reduces contrast and adds noise to the subtracted image.

Medical imaging with monochromatic beams produced with synchrotron X-rays and crystal monochromators show significantly improved image quality compared to conventional methods in several fields, including transvenous coronary angiography, mammography and computed tomography. However, the use of synchrotron radiation for clinical applications may not become widespread due to the synchrotron size, cost and complexity of operation.

The development of compact sources of narrow energy-band X-rays for radiography has been the subject of several studies in recent years. One such proposal is for the use of a rotating anode X-ray source for digital subtraction coronary angiography.

The source utilizes a high-energy (up to 1 MeV) electron beam in conjunction with selected rare-earth anodes. Anode materials can be chosen so that their characteristic emission lines bracket the iodine K absorption edge. The source provides adequate beam intensity for digital subtraction imaging of the coronary arteries with an iodine contrast agent delivered intravenously. In that particular system design, however, the resulting energy bandwidth is not narrow because the beam, along with the characteristic X-rays, includes a substantial amount of bremsstrahlung radiation. The bremsstrahlung continuum increases noise to the subtracted image.

SUMMARY OF THE INVENTION

It is one object of this invention to provide a method and apparatus that transmits X-ray beams through a bent crystal, such as a bent Laue crystal, which produces a diffracted highly monochromatic X-ray beam.

It is another object of this invention to provide a method and apparatus that uses a compact divergent source, such as a rotating anode X-ray tube, to transmit through a bent crystal and emit X-rays having a solid angle of at least about 5° by at least about 5°.

It is still another object of this invention to provide a method and apparatus for a transmitting X-ray beams through a non-cylindrical shaped or logarithmic spiral shaped crystal and to rock a position of the bent crystal until a large area of divergent monochromatic beams are emitted from the bent crystal.

A bent Laue crystal monochromator according to this invention can diffract an area beam of characteristic X-rays from a rotating anode X-ray tube, for example, thereby eliminating the bremsstrahlung problem associated with conventional systems. An area beam is known as a beam having an area large enough (e.g., about 5 cm×about 5 cm) for radiography. A monochromator according to this invention was initially tested at the X12A beam line at the National Synchrotron Light Source (NSLS), Brookhaven National Laboratory, Upton, N.Y., using molybdenum, silver and barium fluorescence targets excited by a synchrotron white beam.

The Laue crystal monochromator of this invention produces a two-dimensional, uniform, monochromatic beam, which can be used for radiography purposes, using standard X-ray generators. The energy bandwidth of the monochromatic beam is about 2% ($\Delta E/E$) which makes possible the selection of a single emission line from a target or a tube. The Laue crystal monochromator, according to one preferred embodiment of this invention, is able to vary the Bragg angle and bending parameters to accept different energies produced by various targets. At the same time, the monochromatic area beam with a solid angle of greater than at least about 5°×at least about 5° can be separated from the direct beam and bremsstrahlung radiation at distances of less than about one meter.

The properties of the Laue crystal monochromator of this invention make it nearly ideal for monochromatic beam diagnostic radiography. The monochromatic beam can be tuned in energy to bracket the K-edge of radiographic contrast elements, such as iodine. Dual-energy subtraction techniques, such as digital subtraction, can then be used to enhance image contrast in diagnostic radiography programs, such as coronary angiography and computed tomography. In addition, a bent crystal monochromator of this invention can be easily incorporated into an existing X-ray source as an add-on device.

BRIEF DESCRIPTION OF THE DRAWINGS

The above objects and other features of the method and apparatus according to this invention will become more apparent when taken in view of the drawings, wherein.

DESCRIPTION OF PREFERRED EMBODIMENTS

Figure 1:
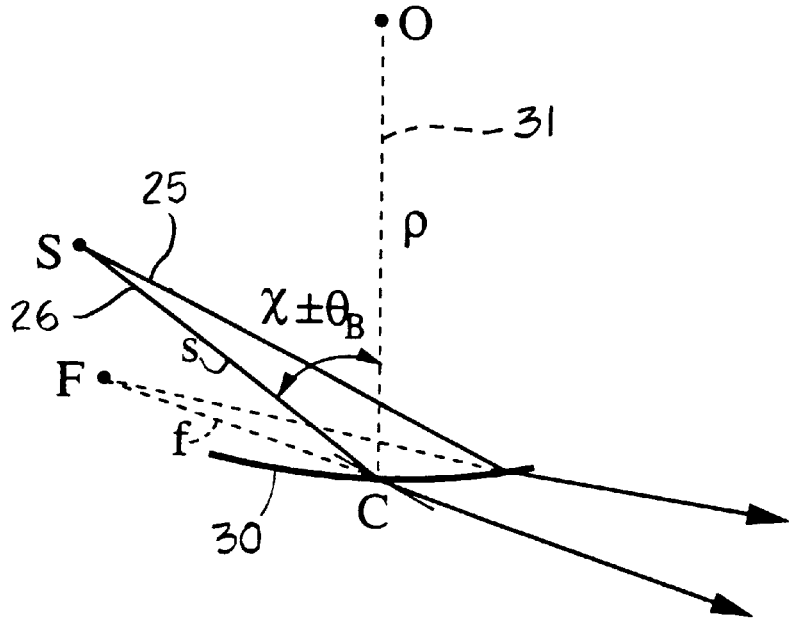
FIG. 1 is a diagrammatic view of a crystal monochromator, such as a Laue crystal monochromator, having a bent crystal with an approximately cylindrical shape of a crystal surface, according to one preferred embodiment of this invention.

The geometry associated with a cylindrically bent surface of a crystal monochromator, such as a Laue crystal monochromator, is shown in FIG. 1. The X-rays 25, 26 from a point source S are reflected by Bragg planes in bent crystal 30 and are focused at a virtual focal point F. An asymmetry angle $\chi$ is defined as an angle between crystal surface normal 31 and the Bragg planes used for the reflection of X-rays 25, 26. Bragg angle $\theta_B$ is the angle between the incident X-rays 25, 26 and the Bragg planes. Distance s is measured between source point S and the center of crystal 30 and distance $f$ is measured between the virtual focal point F and crystal 30 ($f$ is negative for a virtual focal point). If there is no variation of the angle of incidence along the crystal surface of crystal 30, then the reflected beam will be a monochromatic beam. A Table of Equations identifying equations discussed throughout this specification is found at the end of this Description of Preferred Embodiments. Equations 1 and 2 represent a condition for producing a monochromatic beam (the Rowland condition) where $\rho$ is a bending radius of a bent crystal 30, $\rho$ is positive when source point S is on a concave side of crystal 30 and is negative when source point S in on a convex side of crystal 30. The upper sign corresponds to the case when the source and the center of bending are on different sides of the crystal diffraction planes, and the lower sign corresponds to the case when the source and the center of bending is on the same side of the crystal diffraction planes.

Figure 2:
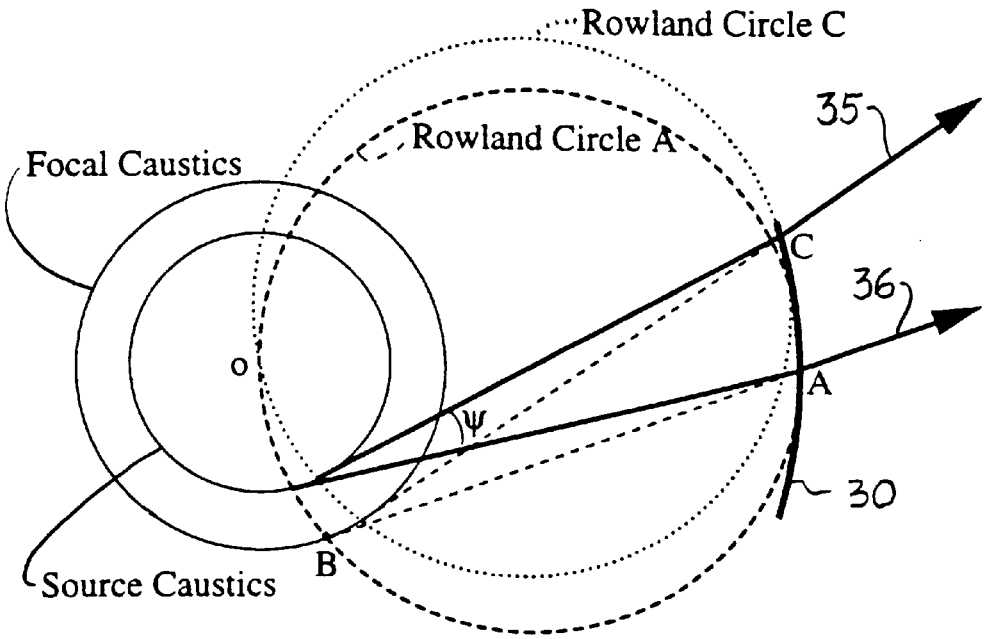
FIG. 2 is a diagrammatic view of aberrations of beams or rays transmitted through a bent crystal, according to one preferred embodiment of this invention.

The source caustics is defined as a circle of radius $\rho \sin(\chi \pm \theta_B)$ centered at the center of bending and the focal caustics as a circle of radius $\rho \sin(\chi \pm \theta_B)$ also centered at the center of bending. Equation 1 requires source point S to be at an intersection of the Rowland circle and the source caustics, as shown in FIG. 2. In this embodiment, focal point F is at the intersection of the Rowland circle and the focal caustics.

For simplicity, only the lower-sign case will now be discussed. For point source S, the virtual source as seen by a patient and a detector is not pointlike. As shown in FIG. 2, for a small region of bent crystal 30 around point A, the corresponding virtual focal point B is the intersection of the Rowland circle and the focal caustics, and the direction of diffracted beam 36 is along line AB. As point A sweeps to point C through bent crystal 30, characterized by angle $\psi$, the corresponding focal point sweeps through an arc on the focal caustics. This aberration of the virtual source point does not degrade the resolution of the resulting image because diffracted beams 35, 36 originate from an array of sources each with a specific direction of emission tangent to the focal caustics.

Figure 3:
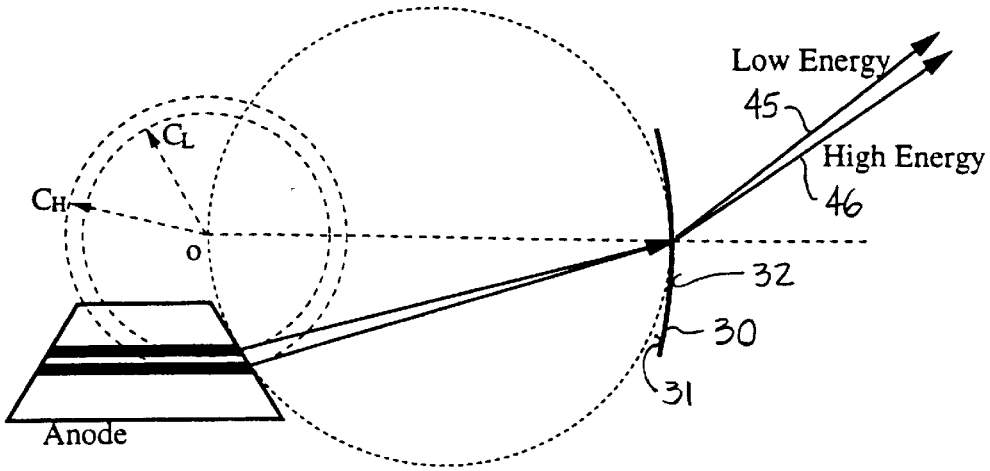
FIG. 3 is a diagrammatic view showing one bent crystal which reflects beams having at least two different energy levels.

As shown in FIG. 3, according to one preferred embodiment of this invention, the beams from a source are transmitted through crystal 30, first through concave surface 31 and then through convex surface 32.

Figure 5:
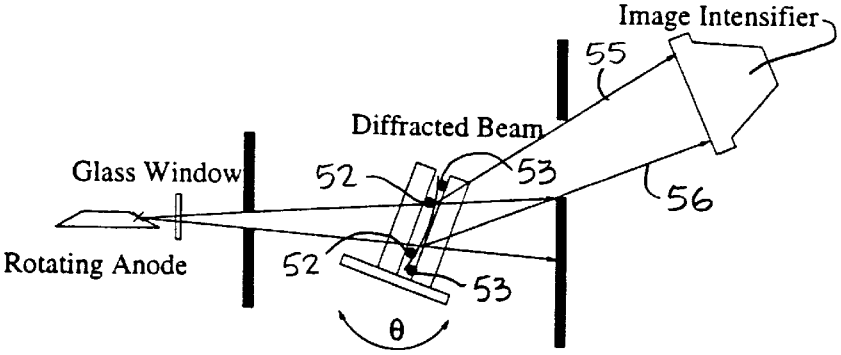
FIG. 5 is a diagrammatic view of an apparatus for obtaining divergent monochromatic beams, according to one preferred embodiment of this invention.
Figure 6:
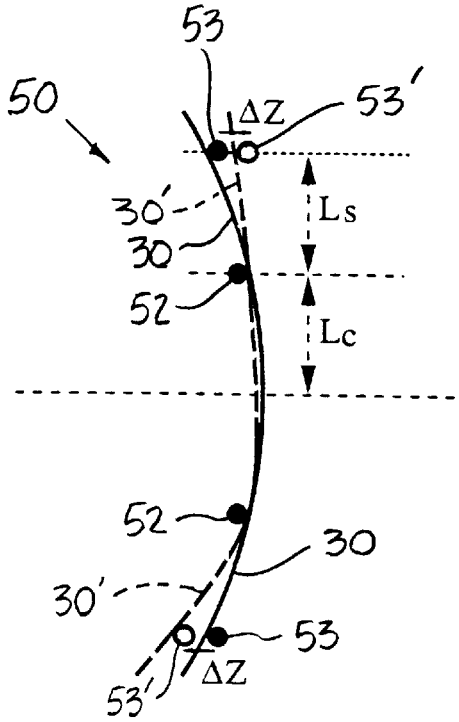
FIG. 6 is a diagrammatic view of a crystal bent by a four-bar bender, showing an evenly bent crystal having an approximately cylindrical shape (solid line), according to one preferred embodiment of this invention, and a differentially bent crystal having a non-cylindrical shape or an approximate logarithmic spiral shape (dashed line), according to another preferred embodiment of this invention.
Figure 7:
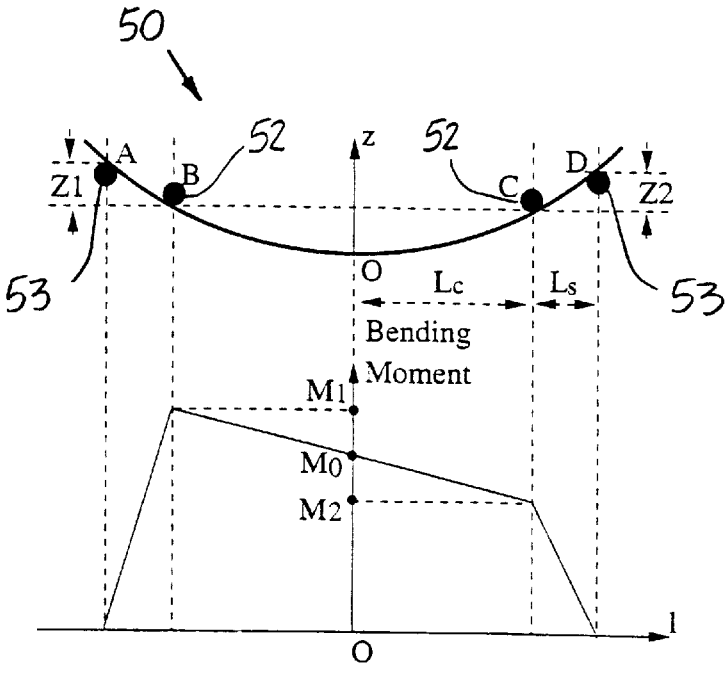
FIG. 7 is a diagrammatic view of a crystal differentially bent in a four-bar bender, wherein distance Z1 is different than distance Z2, according to another preferred embodiment of this invention.

In one preferred embodiment of this invention, crystal 30 is bent with four-bar bender 50, a device which preferably comprises four parallel bars that bend a rectangular crystal by pushing crystal 30 with two inner bars 52 and pulling crystal 30 with two outer bars 53, such as shown in FIGS. 5–7. In its unbent form, crystal 30 has generally planar opposing face surfaces and preferably but not necessarily has an overall rectangular shape. In one preferred embodiment according to this invention, crystal 30 is constructed of silicon and has a uniform thickness of about 0.2 mm to about 3.0 mm, so that asymmetry angle $\chi$ is between about 0 degrees and about 40 degrees. Using four-bar bender 50 to bend crystal 30, it is possible to achieve a cylindrically bent crystal 30 by displacing inner bars 52 and corresponding outer bars 53 by a same amount or distance, and a problem may exist because the angle the crystal planes make with the incident X-rays is not the same across the crystal surface of crystal 30. This problem can be solved according to this invention, with differential bending, by unbending outer bar 53 by an amount or distance $\Delta z$ and bending inner bar 52 by an equal amount or distance $\Delta z$, where distance $\Delta z$ corresponds to a differential displacement which is in addition to the displacement required to bend crystal 30 into a cylindrical shape. The differential bending according to this invention modifies the concave crystal surface and the opposing convex crystal surface of crystal 30 from a cylindrical shape to a non-cylindrical shape. In one preferred embodiment of this invention, the differential bending forces or modifies crystal 30 into an approximate logarithmic spiral shape, which is a non-cylindrical shape. The amount of differential bending is given by Equation 3, where $2L_c$ is the distance between two inner bars 52, $L_s$ is the distance between one outer bar 53 and one corresponding inner bar 52 and $\rho$ is the bending radius.

As used throughout this specification and in the claims, the term cylindrical is intended to relate to a surface that is either precisely cylindrical or cylindrical within working tolerances. As used throughout this specification and in the claims, the term non-cylindrical is intended to relate to a surface that is not either precisely cylindrical or cylindrical within working tolerances. As used throughout this specification and in the claims, the term logarithmic spiral shape is intended to relate to a surface that either precisely follows a logarithmic curve or that approaches or approximates a logarithmic curve.

The bending of a wide crystal 30, such as with four-bar bender 50 can be modeled by a four-point loaded beam, as shown in FIG. 7. The bending moment varies linearly along crystal 30, as shown in FIG. 7, depending on the forces applied at end portions of crystal 30. Crystal 30 is differentially bent by applying different forces at points A and D, as shown in FIG. 7, which results in distance Z1 being different than distance Z2. It is apparent that crystal 30 can be bent into any suitable non-cylindrical shape, such as a logarithmic spiral shape, using suitable mechanisms other than four-bar bender 50, which can produce bending results the same as or similar to results achieved with four-bar bender 50. For example, in one preferred embodiment of this invention it is possible to bend crystal 30 into a logarithmic spiral shape or any other suitable non-cylindrical shape by positioning edges of crystal 30 between opposing clamping members which when forced toward each other clamp and bend crystal 30 between the opposing members to form non-cylindrically curved opposing face surfaces of crystal 30. It is apparent that such clamping apparatus or any other suitable bending apparatus can be used in lieu of four-bar bender 50 to accomplish similar or better bending precision, for example to more closely approach a theoretical logarithmic spiral shape, than the bending precision accomplished with four-bar bender 50.

In one experiment according to this invention, the $K_{\alpha 1}$ (low-energy $E^-$=32.19 keV) line of the Ba was used for the low-energy beam and the $K_{\alpha 1}$ (high-energy $E^+$=34.72 keV) line of the Ce was used for the high-energy beam. For the silicon[111] reflection the Bragg angles for $E^+$ and $E^-$ were 3.522° and 3.265°, respectively, with $\Delta\theta=(\theta_B^+-\theta_B^-)=0.257°$. One main operational challenge was to switch between the high and low energies in a time period on the order of 0.01 s; this time is required, for example, to minimize motion artefacts of subtraction angiography during the diastolic cycle of the cardiac motion. This timed switching can be achieved by coating an anode with layers of Ba and Ce film and switching the focal point position of the incident electron beam. Using one crystal 30, there is an angle between monochromatic high-energy beam 46 and monochromatic low-energy beam 45, as shown in FIG. 3. By using two crystals 30 in a proper configuration, the virtual source can be coincident for both high-energy beam 46 and low-energy beam 45. In this case, there is no crossing angle between both high-energy beam 46 and low energy beam 45.

The $E^+$ and $E^-$ beams can be diffracted by the same bent crystal 30 using the same set of diffraction planes. This can be achieved by moving source point S on the Rowland circle for different energies and shaping the anode so that it intercepts the Rowland circle, as shown in FIG. 3.

For low-energy beam 45 and high-energy beam 46, the source caustics radii of curvature are governed by Equations 4 and 5, so the motion of source point S is governed by Equation 6. In one preferred embodiment of this invention, the source point motion is 2.2 mm for a source-to-monochromator distance of 0.5 m, using the silicon[111] reflection. The two reflected beams traverse an object at an angle $\Delta\theta$ with respect to each other. Because of the difference between the high-beam and the low-beam images, the subtracted image will have artefacts due to the misregistration of the two images. In one preferred embodiment of this invention, one major artefact is from bone edge mismatch between the two images. For the silicon[111] reflection, $\Delta\theta$ is 4.5 mrad, which is near an upper limit of an acceptable crossing angle.

A differential bending amount or distance $\Delta z$ is calculated using Equation 3 and is practically the same for both high-energy beam 46 and low-energy beam 45, so the differential bending will allow the whole area of both beams 45, 46 to be reflected.

Figure 4:
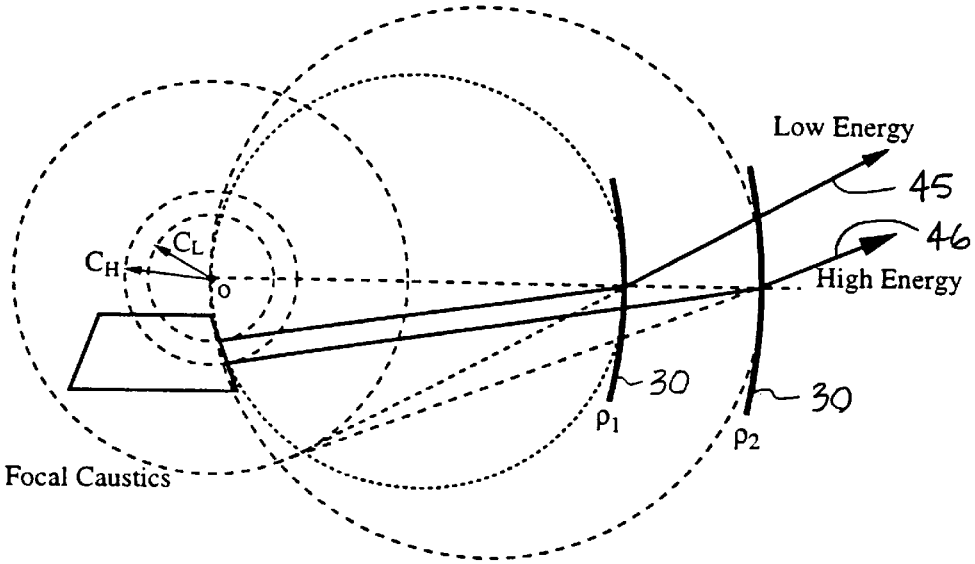
FIG. 4 is a diagrammatic view showing two bent crystals which reflect beams having at least two different energy levels.

Now consider using two crystals 30 to diffract beams of two different energies assuming that the same crystal reflection is used for both crystals 30, such as shown in FIG. 4. The radii of the source and focal caustics for $E^-$ and $E^+$ are defined by Equations 7–10, where $C_L$ and $C_H$ are the source caustics radii, $D_L$ and $D_H$ are the focal caustics radii, $\rho_1$ is the bending radius of crystal 30 which reflects low-energy beam 45 and $\rho_2$ the bending radius of crystal 30 which reflects high-energy energy beam 46.

The focal caustics defines the shape of the virtual object for the diffracted beam. Requiring $D_L=D_H$, as shown in FIG. 4, and shaping the anode to intercept the Rowland circles, the virtual sources of the diffracted beams coincide, thus providing Equation 11. In such embodiment, the motion of source point S required to switch between high-energy beam 46 and low-energy beam 45 is governed by Equation 12, where $\overline{\theta}_B=(\theta_B^-+\theta_B^+)\ 2$ and $\overline{\rho}=(\rho_1+\rho_2)\ 2$.

An experiment was conducted with a compact source, according to one preferred embodiment of this invention, as shown in FIG. 5. The setup, values for different parameters of components, and results of the experiment are discussed in a paper by Z. Zhong, D. Chapman, R. Menk, J. Richardson, S. Theophanis and W. Thomlinson, entitled Monochromatic energy-subtraction radiography using a rotating anode source and a bent Laue monochromator, *Phys. Med. Biol.*, 42 (1997) pp. 1751–1762, the entire contents of such paper being incorporated by reference into and made a part of this specification. Through such experiment, it was determined that diffracted beams 55, 56, as shown in FIG. 5, were each almost ideally monochromatic.

The bent Laue crystal monochromator of this invention is used to selectively diffract a cone beam of emission line X-rays produced by a conventional X-ray compact source. The bent crystal 30 of this invention solves a significant mismatch between the narrow angular bandwidth in diffraction of X-rays from a perfect crystal (e.g. the Darwin width for silicon[111] reflection is 5 $\mu$rad at 33 keV), and the large divergence of the cone beam necessary for medical imaging with a conventional source (about 0.1 rad). Bending crystal 30 has at least two main advantages: one is to geometrically enable the diffracting planes to make the same Bragg angle with each ray of the incident beam and, therefore, to produce a monochromatic beam; the other is that differential bending increases the angle width and the integrated reflectivity of the crystal reflection.

For a cylindrically bent crystal 30 there is a systematic deviation from the Bragg condition which is proportional to the square of the divergence of the incident beam. This deviation is negligible only if the asymmetry angle is chosen to be close to the Bragg angle. To increase the Full Width at Half Maximum (FWHM) of the reflection the asymmetry angle is preferably much larger than the Bragg angle, in which case the deviation is comparable to the FWHM of the reflection. This deviation from the Bragg condition can be compensated by controlling the bending of crystal 30. The median angle of the crystal planes at any point on the crystal surface corresponding to the beam divergence can deviate from that of the cylindrical bending condition.

FIG. 6 shows how a controlled deviation from cylindrical bending can be achieved for crystal 30 bent with four-bar bender 30, according to one preferred embodiment of this invention. An ideal cylindrically bent crystal 30 is achieved by displacing outer bars 53 by the same amount or distance, and the angle the crystal planes make with the incident X-ray can be calculated. If, in addition to the displacement required to bend crystal 30 into a cylindrical shape, the upper (as shown in FIG. 6) outer bar 53 is unbent by an amount or distance Δz, as indicated in FIG. 6 by the solid circles 53 and the solid line schematically showing the crystal surface; and the lower (as shown in FIG. 6) outer bar 53 is further bent by an equal amount or distance Δz, as indicated in FIG. 6 by the open circles 53' and the dashed line schematically showing the crystal surface, crystal 30' will deviate from a cylindrical shape into a non-cylindrical or logarithmic spiral shape.

Since the diffracting crystal planes across the bent crystal surface make the same angle with respect to the incident divergent beam, the energy of the diffracted beam is uniform over its area. The energy bandwidth of the monochromatic beam, in one preferred embodiment approximately 2%, is much larger than the width of the target emission lines. Thus, the energy of the monochromatic beam can be one of the emission line energies of the X-ray source in an energy range which is useful for medical imaging.

An experiment was conducted according to another preferred embodiment of this invention. The setup, parameters and associated values, and the results are described in a publication by Z. Zhong, D. Chapman, W. Thomlinson, F. Arfelli, R. Menk, entitled A bent Laue crystal monochromator for nonochromatic radiography with an area beam, *Nuclear Instruments and Methods in Physics Research*, A 399 (1997) p. 489–498, the entire contents of such paper being incorporated by reference into and made a part of this specification.

The uniformity of diffracted beams 55, 56 depends on matching the angle of the crystal planes with the divergence of the incoming beam at all points on crystal 30. If the angle that each of the crystal planes makes with the beam is within the reflection FWHM of the Bragg angle then the beam will be reflected; otherwise the reflectivity is close to zero. With four-bar bender 50, crystal 30 was capable of reflecting the full beam with a suitable corresponding image size at the detector position. The variation in intensity of the reflected beam was less than 10%, which can be corrected for by proper calibration images.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

Table of Equations

| | |
|---|---|
| $s = \rho \cos(\chi \pm \theta_B)$ | Equation 1 |
| $f = -\rho \cos(\chi \mp \theta_B)$ | Equation 2 |
| $\Delta z = \left(\frac{L_s L_c^2}{2} + \frac{2}{3} L_s^2 L_c\right) \frac{1}{\rho^2} \tan(\chi - \theta_B)$ | Equation 3 |
| $C_L = \rho \sin(\chi - \theta_B^-)$ | Equation 4 |
| $C_H = \rho \sin(\chi - \theta_B^+)$ | Equation 5 |
| $M \cong \rho \cos(\chi - \theta_B^-)\Delta\theta$ | Equation 6 |
| $C_L = \rho_1 \sin(\chi - \theta_B^-)$ | Equation 7 |
| $D_L = \rho_1 \sin(\chi + \theta_B^-)$ | Equation 8 |
| $C_H = \rho_2 \sin(\chi - \theta_B^+)$ | Equation 9 |
| $D_H = \rho_2 \sin(\chi + \theta_B^+)$ | Equation 10 |
| $\frac{\rho_1}{\rho_2} = \frac{\sin(\chi + \theta_B^+)}{\sin(\chi + \theta_B^-)}$ | Equation 11 |

-continued

Table of Equations

| | |
|---|---|
| $M = C_H - C_L \cong 2\Delta\theta\bar{\rho} \frac{\sin\bar{\theta}_B}{\sin(\chi + \bar{\theta}_B)}$ | Equation 12 |

We claim:

1. A method for producing a monochromatic beam, the method comprising:

generating a plurality of beams from a polyenergetic source;

transmitting the beams through a bent crystal having non-cylindrical shape;

positioning the bent crystal with respect to the polyenergetic source to emit a plurality of divergent monochromatic beams from the bent crystal wherein the bent crystal is differentially bent in a logarithmic spiral shape;

wherein the logarithmic spiral shape is achieved by mounting and differentially bending the crystal in a four-bar bender;

wherein the two outer bars of the four-bar bender each is moved a same distance with respect to a corresponding one of two inner bars of the four-bar bender to bend the crystal into a cylindrical shape and then the outer bars are differentially displaced with respect to each other;

wherein the outer bars are differentially displaced with respect to each other by displacing one of the outer bars by a differential Δz to at least partially unbend the bent crystal and further displacing another of the outer bars by the differential distance Δz to further bend the bent crystal.

2. A method according to claim 1 wherein the beams generated have a wavelength in a X-ray bandwidth.

3. A method according to claim 1 wherein the beams are first transmitted through a concave surface of the bent crystal and then through a convex surface of the bent crystal.

4. A method according to claim 1 wherein the different distance Δz bending is governed by:

$$\Delta z = \left(\frac{L_s L_c^2}{2} + \frac{2}{3} L_s^2 L_c\right) \frac{1}{\rho^2} \tan(\chi - \theta_B)$$

where $2L_c$ is a first distance between the two inner bars and $L_s$ is a second distance between one of the outer bars and a corresponding one of the inner bars.

5. A method according to claim 1 wherein the bent crystal is rocked in a plane of diffraction until the divergent monochromatic beams are emitted from the bent crystal.

6. A method according to claim 1 wherein a plurality of white beams are transmitted through the bent crystal and the divergent monochromatic beams are separated from the white beams by a fixed angle of diffraction.

7. A method according to claim 1 wherein the divergent monochromatic beams have a two-dimensional solid angle of at least about 5 degrees by at least about 5 degrees.

8. A method according to claim 1 wherein the divergent monochromatic beams are two-dimensional.

9. A method according to claim 1 wherein an energy bandwidth (ΔE/E) of the divergent monochromatic beams is about 2%.

10. A method according to claim 1 wherein the divergent monochromatic beams are tuned to above and below a K-edge of a radiographic contrast element.

11. A method according to claim 10 wherein the tuned divergent monochromatic beams are used for dual energy digital subtraction radiography.

12. A method according to claim 1 wherein the divergent monochromatic beams are tuned to above a K-edge of a radiographic contrast element.

13. A method according to claim 12 wherein the tuned divergent monochromatic beams are used to enhance an image contrast.

14. A method according to claim 1 wherein the bent crystal is a bent Laue crystal.

15. A method according to claim 1 wherein the divergent monochromatic beams are transmitted through the bent crystal with asymmetric transmission geometry.

16. A method according to claim 1 wherein the polyenergetic source is an X-ray rotating anode source.

* * * * *

UNITED STATES PATENT AND TRADEMARK OFFICE

CERTIFICATE OF CORRECTION

PATENT NO : 6,038,285
DATED : 14 March 2000
INVENTOR(S) : Zhong ZHONG et al.

It is certified that error appears in the above-identified patent and that said Letters Patent are hereby corrected as shown below:

In Column 8, line 32, after "differential" insert --distance--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*